US011520250B2

(12) United States Patent
Hoshino et al.

(10) Patent No.: US 11,520,250 B2
(45) Date of Patent: Dec. 6, 2022

(54) DEVELOPING DEVICE WITH FILTER AND A PLURALITY OF AIR EXIT PATHS AND IMAGE FORMING APPARATUS

(71) Applicant: FUJIFILM Business Innovation Corp., Tokyo (JP)

(72) Inventors: Yuta Hoshino, Ebina (JP); Kiyohito Horii, Ebina (JP); Taiyou Uehara, Ebina (JP); Takashi Ochi, Ebina (JP); Shota Igawa, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/402,022

(22) Filed: Aug. 13, 2021

(65) Prior Publication Data

US 2022/0308498 A1 Sep. 29, 2022

(30) Foreign Application Priority Data

Mar. 29, 2021 (JP) ..... JP2021-054503

(51) Int. Cl.
*G03G 15/08* (2006.01)
*G03G 21/20* (2006.01)
*G03G 15/09* (2006.01)

(52) U.S. Cl.
CPC ..... *G03G 15/0891* (2013.01); *G03G 15/0812* (2013.01); *G03G 15/0889* (2013.01);
(Continued)

(58) Field of Classification Search
CPC ..... G03G 15/0891; G03G 15/0889; G03G 15/0898; G03G 15/0893; G03G 15/0812;
(Continued)

(56) References Cited

U.S. PATENT DOCUMENTS 4,583,112 A * 4/1986 Morano ..... G03G 15/0898 399/103
4,800,411 A 1/1989 Tanaka et al.
(Continued)

FOREIGN PATENT DOCUMENTS

JP 2004-45942 A 2/2004
JP 2008-26487 A 2/2008
(Continued)

OTHER PUBLICATIONS

Extended European Search Report dated Feb. 7, 2022, issued by the European Patent Office in counterpart European Patent Application No. 21195237.9.

*Primary Examiner* — Arlene Heredia
*Assistant Examiner* — Laura Roth
(74) *Attorney, Agent, or Firm* — Sughrue Mion, PLLC

(57) ABSTRACT

A developing device includes: a housing in which a developer is contained; a cover member configured to cover an upper opening of the housing; a developer holder that is supported by the housing and holds the developer on an outer surface and rotates; and a regulating member that faces the developer holder and is configured to regulate an amount of the developer on the outer surface. The device also includes a first exit path inclined toward an inside of the housing which is configured to exit air from the inside of the housing to an outside of the cover member. A second exit path connects the first exit path and a filter member provided on the cover member, in which the filter member prevents passage of the developer and allows for passage of air.

19 Claims, 8 Drawing Sheets

(52) U.S. Cl.
CPC ..... *G03G 15/0898* (2013.01); *G03G 15/0942* (2013.01); *G03G 21/206* (2013.01); *G03G 2215/0872* (2013.01); *G03G 2221/1645* (2013.01)

(58) Field of Classification Search
CPC ..... G03G 15/0896; G03G 15/0942; G03G 21/206; G03G 2221/1645; G03G 21/1832; G03G 2215/0866; G03G 2215/0872
See application file for complete search history.

(56) References Cited

U.S. PATENT DOCUMENTS

| | | | | |
|---|---|---|---|---|
| 2005/0185976 | A1* | 8/2005 | Morimoto | G03G 15/04045 399/50 |
| 2008/0124136 | A1 | 5/2008 | Oshikawa | |
| 2011/0008068 | A1 | 1/2011 | Kunihiro et al. | |
| 2014/0270838 | A1* | 9/2014 | Yoshizawa | G03G 15/0893 399/99 |
| 2016/0306300 | A1 | 10/2016 | Hamada et al. | |
| 2018/0129150 | A1 | 5/2018 | Taniguchi et al. | |
| 2019/0025730 | A1 | 1/2019 | Akaike et al. | |
| 2019/0302691 | A1 | 10/2019 | Kawahito | |

FOREIGN PATENT DOCUMENTS

| | | | | |
|---|---|---|---|---|
| JP | 2009-115990 | A | 5/2009 | |
| JP | 2014-178661 | A | 9/2014 | |
| JP | 2015-68911 | A | 4/2015 | |
| JP | 2016-206647 | A | 12/2016 | |
| JP | 2017-90495 | A | 5/2017 | |
| JP | 2018-31827 | A | 3/2018 | |
| JP | 2020046590 | A * | 3/2020 | G03G 15/0865 |
| WO | 2019/013421 | A1 | 1/2019 | |

* cited by examiner

DEVELOPING DEVICE WITH FILTER AND A PLURALITY OF AIR EXIT PATHS AND IMAGE FORMING APPARATUS

CROSS-REFERENCE TO RELATED APPLICATIONS

This application is based on and claims priority under 35 USC 119 from Japanese Patent Application No. 2021-054503 filed on Mar. 29, 2021.

BACKGROUND

Technical Field

The present disclosure relates to a developing device and an image forming apparatus.

Related Art

There is an image forming apparatus including an image carder that carries a latent image on a surface; and a developing device that develops the latent image, in which the developing device includes a developer container that contains a developer inside, a developer carrier that carries the developer in the developer container on a surface, an opening of the developer container provided in the developer container in order to expose a part of the surface of the developer carrier to an outside of the developer container, and a developer carrier drive configured to move the surface of the developer carrier between an inside and the outside of the developer container, and in the image forming apparatus in which the developing device is configured to move between a developing position where the developer carrier faces the image carrier and a non-developing position other than the developing position, an internal pressure increase preventer configured to prevent an internal pressure increase in the developer container is provided (Patent Literature 1).

There is also a developing device including a developer carrier that carries a developer on a surface and moves the surface to supply a developer to a latent image on a surface of a latent image carrier in a developing region facing the latent image carrier; a developer transporting member configured to apply a transport force by rotation to the developer in a developer container that contains the developer to be supplied to the developer carrier; a pressure relief opening configured to exit gas inside the developer container to an outside of the device and prevent an increase in an air pressure inside the developer container, and a filter member provided in the pressure relief opening to prevent the developer from being exited from the pressure relief opening, in which a developer moving path shielding member configured to close a moving path of the developer that is flipped up by rotation of the developer transporting member toward the filter member is included (Patent Literature 2).

CITATION LIST

Patent Literature

Patent Literature 1: JP-A-2004-045942
Patent Literature 2: JP-A-2014-178661

SUMMARY

Aspects of non-limiting embodiments of the present disclosure relate to saving space, preventing accumulation of a cloud toner in an air flow path, and stabilizing an internal pressure in a developer container.

Aspects of certain non-limiting embodiments of the present disclosure address the above advantages and/or other advantages not described above. However; aspects of the non-limiting embodiments are not required to address the advantages described above, and aspects of the non-limiting embodiments of the present disclosure may not address advantages described above.

According to an aspect of the present disclosure, there is provided a developing device including:

a housing in which a developer is contained;

a cover member configured to cover an upper opening of the housing;

a developer holder that is supported by the housing and holds the developer on an outer surface and rotates;

a regulating member that faces the developer holder and configured to regulate an amount of the developer on the outer surface;

a first exit path inclined toward an inside of the housing and configured to exit air from the inside of the housing to an outside of the cover member; and a second exit path that connects the first exit path and a filter member provided on the cover member, the filter member preventing passage of the developer and allowing passage of the air.

BRIEF DESCRIPTION OF THE DRAWINGS

Exemplary embodiment(s) of the present invention will be described in detail based on the following figures, wherein.

DETAILED DESCRIPTION

Figure 1:
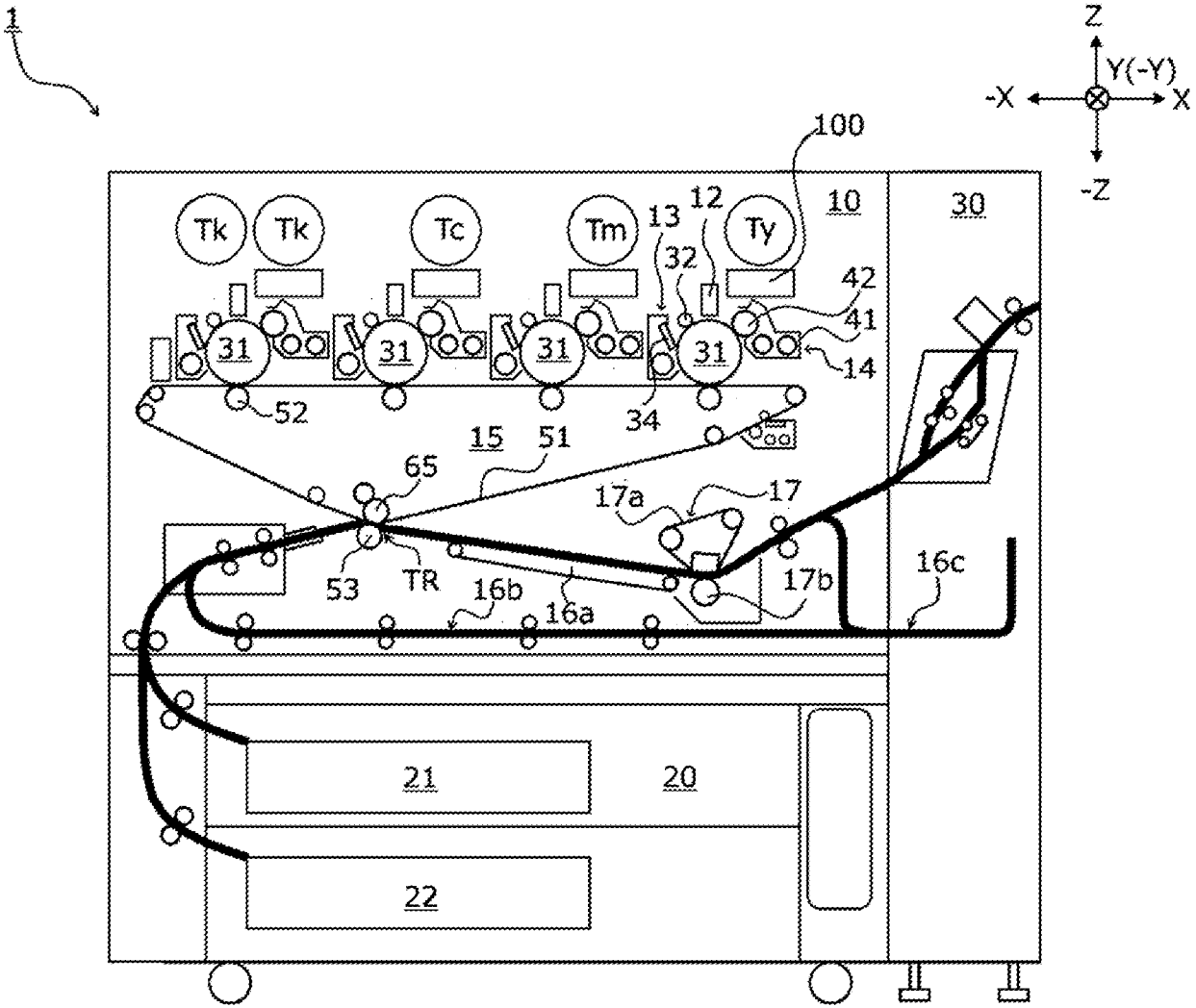
FIG. 1 is a schematic cross-sectional view showing an example of a schematic configuration of an image forming apparatus.

Next, the present disclosure will be described in more detail with reference to the drawings below with reference to exemplary embodiments and specific examples, but the present disclosure is not limited to these exemplary embodiments and specific examples.

In the following description using the drawings, the drawings are schematic, and it should be noted that ratios of dimensions and the like are different from actual ones, and illustration other than members necessary for description is omitted as appropriate for easy understanding.

In order to facilitate understanding of the following description, in the drawings, a front-rear direction is referred to as an X-axis direction, a left-right direction is referred to as a Y-axis direction, and an up-down direction is referred to as a Z-axis direction.

(1) Overall Configuration and Operation of Image Forming Apparatus

(1.1) Overall Configuration of Image Forming Apparatus

FIG. 1 is a schematic cross-sectional view showing an example of a schematic configuration of an image forming apparatus 1 according to a present exemplary embodiment.

The image forming apparatus 1 includes an image former 10, a paper feeding device 20 attached to one end of the image former 10, a paper ejector 30 provided at another end of the image former 10 and configured to eject a printed paper, and an image processor 40 (not shown) configured to generate image information from printing information transmitted from an upper device.

The image former 10 includes a system control device 11 (not shown), an exposure device 12, a photoconductor unit 13, a developing device 14, a transfer device 15, paper transport devices 16*a*, 16*b*, and 16*c*, a fixing device 17, and a drive device 18 (not shown), and forms image information received from the image processor 40 as a toner image on a paper P fed from the paper feeding device 20.

The paper feeding device 20 supplies paper to the image former 10. That is, plural paper loaders that contain papers of different types (for example, material, thickness, paper size, and grain) are included, and the paper P fed from any one of the paper loaders is supplied to the image former 10.

The paper ejector 30 exits the paper on which image output is performed in the image former 10. Therefore, the paper ejector 30 includes a paper ejection container to which the paper after the image output is exited. The paper ejector 30 may have a function of performing a post-processing such as cutting and stapling (staple binding) on a paper bundle output from the image former 10.

(1.2) Configuration and Operation of Image Former

In the image forming apparatus 1 having such a configuration, in the paper feeding device 20 in accordance with a timing of image formation, the paper fed from the paper loader designated for each paper of printing in a print job is fed to the image former 10.

The photoconductor unit 13 is provided below the exposure device 12 in parallel, and includes a photoconductor drum 31 as an image holder to be rotationally driven. A charging roller 32, the exposure device 12, the developing device 14, a primary transfer roller 52, and a cleaning blade 34 are disposed along a rotation direction of the photoconductor drum 31.

The developing device 14 includes a developing housing 41 in which a developer is contained. In the developing housing 41, a developing roller 42 that faces the photoconductor drum 31 is disposed, and a regulating member 45 (see FIG. 2) that regulates a layer thickness of the developer is disposed close to the developing roller 42.

Each developing device 14 has substantially the same configuration except for the developer contained in the developing housing 41, and each forms a toner image of yellow (Y), magenta (M), cyan (C), and black (K).

Above the developing device 14, a replaceable toner cartridge T that contains the developer (a toner including a carrier) and a developer supply device 100 that supplies the developer from each toner cartridge T to the developing device 14 are disposed. In the present exemplary embodiment, toner cartridges Ty, Tm, and Tc of yellow (Y), magenta (M), and cyan (C) and two toner cartridges Tk of black (K) are removable.

A surface of the rotating photoconductor drum 31 is charged by the charging roller 32, and an electrostatic latent image is formed by latent image forming light emitted from the exposure device 12. The electrostatic latent image formed on the photoconductor drum 31 is developed as a toner image by the developing roller 42.

The transfer device 15 includes an intermediate transfer belt 51 onto which toner images of respective colors formed on the photoconductor drums 31 of respective photoconductor units 13 are multiply transferred, the primary transfer roller 52 that sequentially transfers (primarily transfer) the toner images of the respective colors formed on each photoconductor unit 13 to the intermediate transfer belt 51, and a secondary transfer roller 53 that collectively transfers (secondarily transfers) the toner images of the respective colors superimposed and transferred onto the intermediate transfer belt 51 onto the paper Pas a recording medium.

The toner images of the respective colors formed on the photoconductor drums 31 of the respective photoconductor units 13 are sequentially electrostatically transferred (primarily transferred) onto the intermediate transfer belt 51 by the primary transfer roller 52 to which a predetermined transfer voltage is applied from a power supply device (not shown) controlled by the system control device 11, and a superimposed toner image in which toners of the respective colors are superimposed is formed.

With a movement of the intermediate transfer belt 51, the superimposed toner image on the intermediate transfer belt 51 is transported to a secondary transfer TR in which the secondary transfer roller 53 is disposed in press-contact with a backup roller 65 via the intermediate transfer belt 51.

When the superimposed toner image is transported to the secondary transfer TR, the paper is supplied to the secondary transfer TR from the paper feeding device 20 in accordance with the timing. Then, a predetermined secondary transfer voltage is applied from the power supply device controlled by the system control device 11 to the backup roller 65 facing the secondary transfer roller 53 via the intermediate transfer belt 51, and the multiple toner images on the intermediate transfer belt 51 are collectively transferred to the paper.

Residual toner on the surface of the photoconductor drum 31 is removed by the cleaning blade 34 and collected in a waste toner container (not shown). The surface of the photoconductor drum 31 is re-charged by the charging roller 32.

The fixing device 17 includes an endless fixing belt 17*a* that rotates in one direction, and a pressure roller 17*b* that is in contact with a peripheral surface of the fixing belt 17*a* and rotates in one direction, and a nip (fixing region) is formed by a press-contact region between the fixing belt 17*a* and the pressure roller 17*b*.

The paper on which the toner image is transferred in the transfer device 15 is transported to the fixing device 17 via the paper transport device 16*a* in a state where the toner image is not fixed. In the paper transported to the fixing device 17, the toner image is fixed by pressure bonding and heating by the pair of fixing belt 17*a* and the pressure roller 17*b*.

The paper on which the fixing is completed is fed to the paper ejector 30 via the paper transport device 16*b*.

When the image output is performed on both sides of the paper, a front and a back of the paper are reversed by the paper transport device 16*c*, and the paper is again fed to the secondary transfer TR in the image former 10, After transfer of the toner image and fixing of a transfer image are performed, the paper is fed to the paper ejector 30. The paper fed to the paper ejector 30 is subjected to the post-processing such as cutting and stapling (staple binding) as necessary, and then ejected to the paper ejection container.

(2) Configuration and Operation of Main Parts

Figure 2:
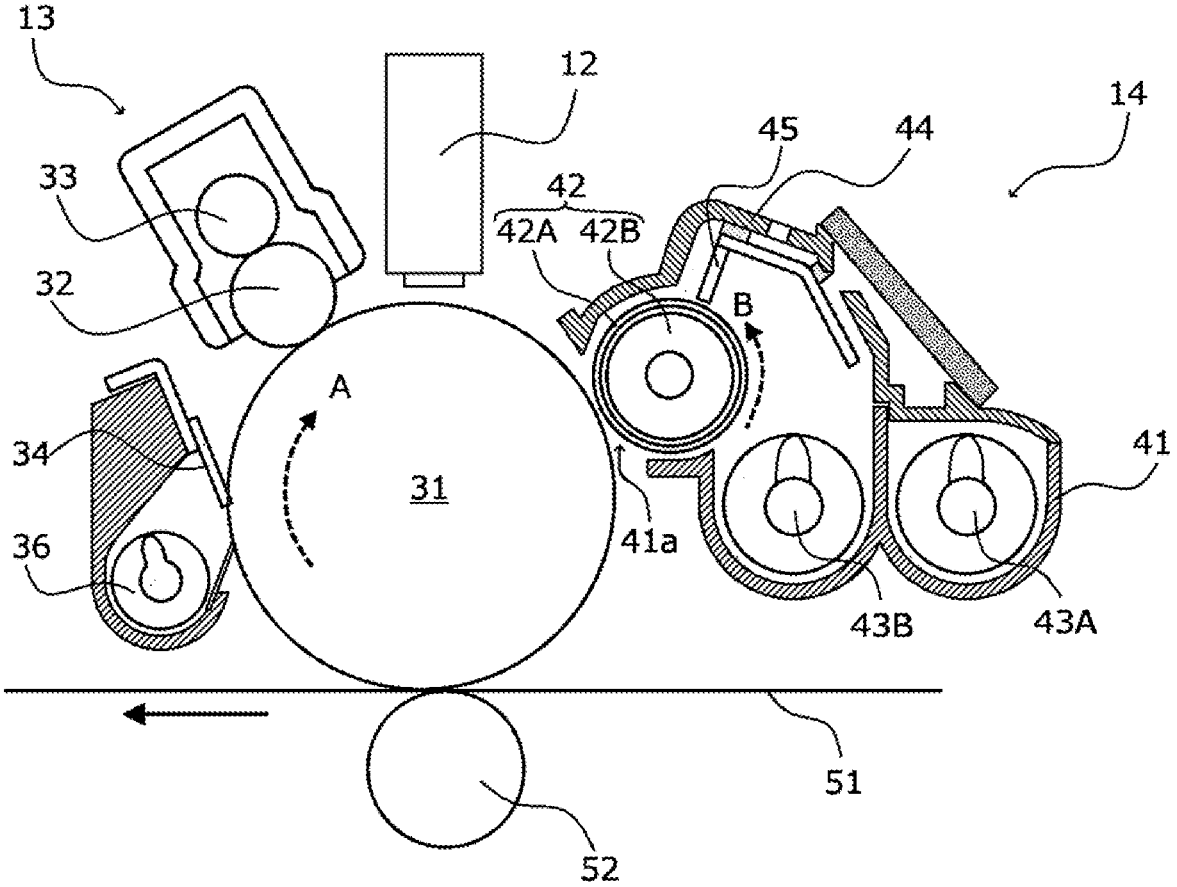
FIG. 2 is a schematic cross-sectional view showing main parts of an image former including a photoconductor unit and a developing device.
Figure 3A:
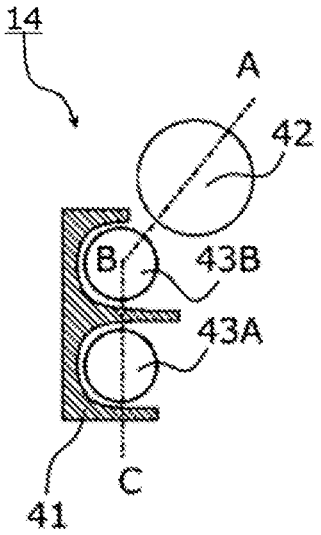
FIG. 3A is a side view of the developing device.
Figure 3B:
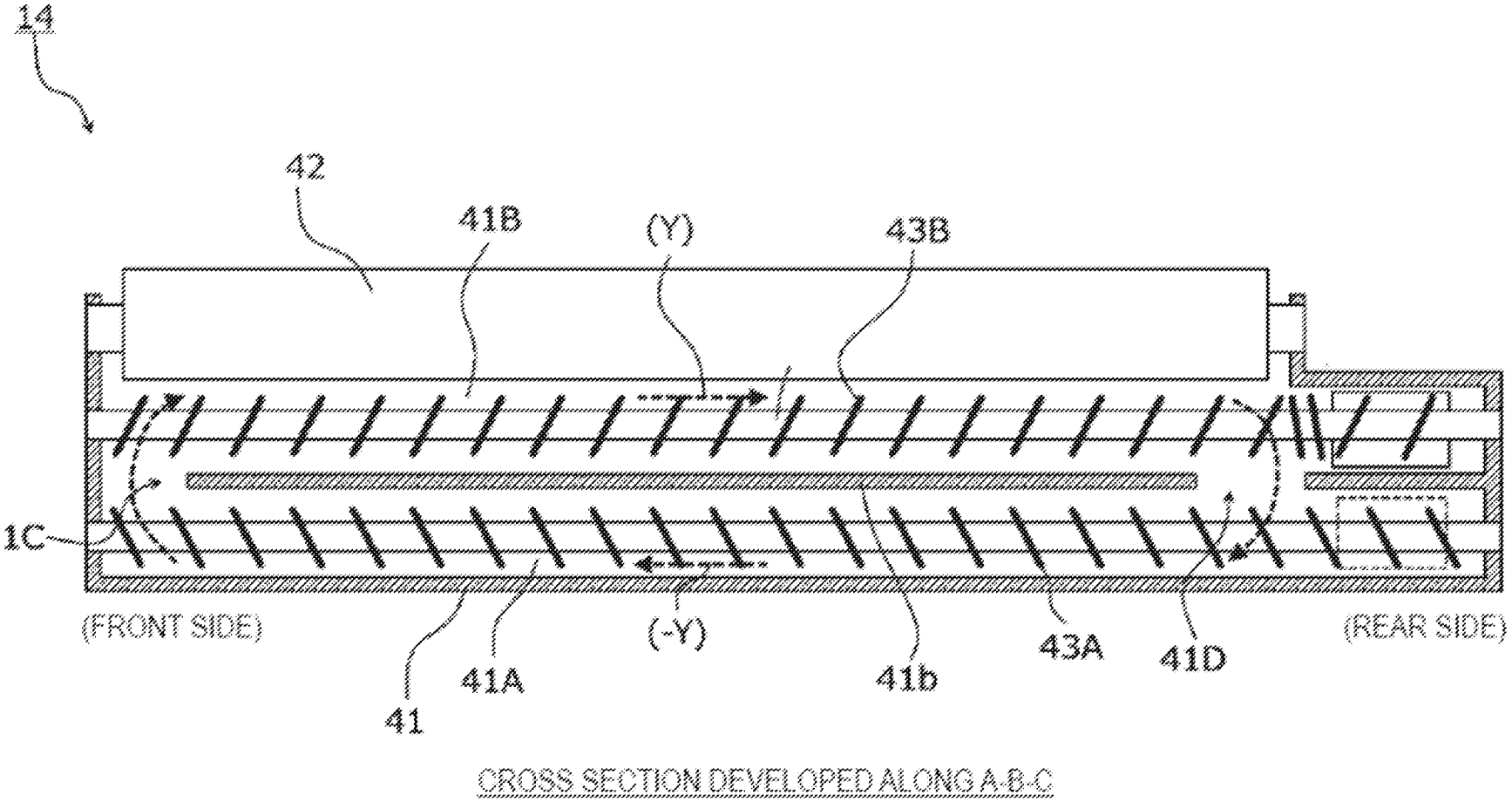
FIG. 3B is a schematic cross-sectional view developed in a plan view along lines A-B-C of FIG. 3A showing transport of a developer in the developing device.
Figure 4:
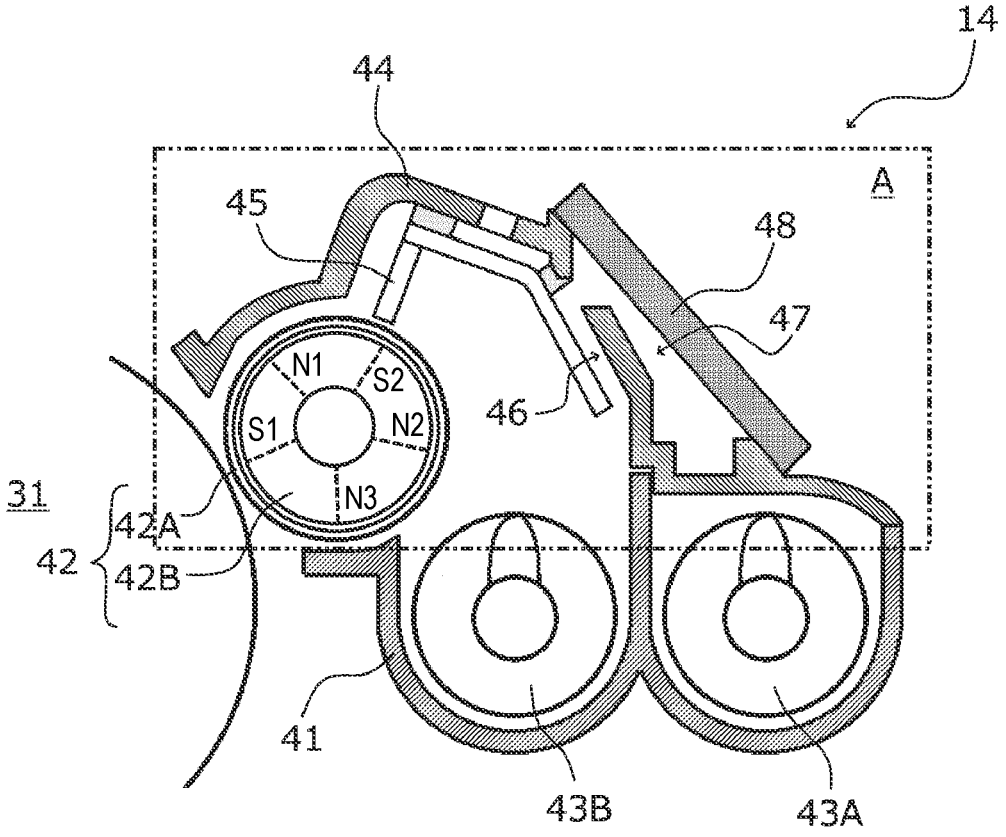
FIG. 4 is a schematic cross-sectional view showing a configuration of the developing device.

FIG. 2 is a schematic cross-sectional view showing main parts of the image former 10 including the photoconductor unit 13 and the developing device 14. FIG. 3A is a side view of the developing device and FIG. 3B is a schematic cross-sectional view developed in a plan view along lines A-B-C of FIG. 3A showing transport of the developer in the developing device 14. FIG. 4 is a schematic cross-sectional view showing a configuration of the developing device 14. Hereinafter, the configuration and operation of the main parts of the image former 10 will be described with reference to the drawings.

(2.1) Structure of Photoconductor Unit

In the photoconductor unit 13, the photoconductor drum 31 is rotatably supported by a unit housing 35, and the charging roller 32, a cleaning roller 33, the cleaning blade 34, and a transporting auger 36 that transports the toner removed by the cleaning blade 34 to a waste toner collection container (not shown) are disposed in the unit housing 35.

(2.2) Configuration and Operation of Developing Device

As shown in FIG. 2, in the developing device 14, the developing roller 42 is rotatably supported by the developing housing 41, and a stirring auger 43A, a supply auger 43B, and the regulating member 45 are disposed in the developing housing 41. The developer is filled around the stirring auger 43A and the supply auger 43B in the developing housing 41, and the stilling auger 43A and the supply auger 43B are closed by the cover member 44.

The developing roller 42 faces an outer circumferential surface of the photoconductor drum 31 through an opening 41*a* formed in the developing housing 41. The developing roller 42 is formed in a columnar shape, and extends along a direction (shown in FIG. 4) from a front side to a rear side of the image forming apparatus 1. The developing roller 42 includes a cylindrical developing sleeve 42A rotatably supported with respect to the developing housing 41, and a magnet 42B as a columnar magnet member provided in an internal space of the developing sleeve 42A and fixed to the developing housing 41.

The developing sleeve 42A is configured such that the developer is held on an outer circumferential surface by a magnetic force of the magnet 42B, and the developer is transported and supplied to the electrostatic latent image on the photoconductor drum 31 by rotation of the developing sleeve 42A. (indicated by an arrow B in FIG. 2).

In addition, the developing device 14 is provided with the stirring auger 43A and the supply auger 43B that transport the developer while stirring. FIG. 3B is the schematic cross-sectional view developed in a horizontal direction along the lines A-B-C of FIG. 3A showing transport (movement) of the developer in the developing device 14. In the developing housing 41; a partition wall 41*b* is erected between the stirring auger 43A and the supply auger 43B, the developing housing 41 is partitioned into two developer containers 41A and 41B, and openings 41C and 41D are formed at both ends in a longitudinal direction of the partition wall 41*b*.

The stirring auger 43A and the supply auger 43B receive a rotational force from a drive source (not shown) and rotate along inner walls of the developer containers 41A and 41B, thereby transporting the developer in a predetermined direction in the developer containers 41A and 41B.

Specifically, the stirring auger 43A transports the developer in the developer container 41A in an arrow (−Y) direction (front side) while stirring the developer as a first circulation path, and the supply auger 43B transports the developer in the developer container 41B in an arrow (Y) direction (rear side) while stirring the developer as a second circulation path. The developer transported in the arrow (−Y) direction moves from the opening 41C to the developer container 41B, and the developer transported in the arrow (Y) direction moves from the opening 41D to the developer container 41A.

Accordingly, the developer in the developing housing 41 circulates while being stirred by the stirring auger 43A and the supply auger 43B. By the stirring of the developer, the toner in the developer is charged.

As shown in FIG. 4, the developing device 14 is provided with the regulating member 45 above the developing roller 42.

The regulating member 45 is disposed in a state of having a predetermined gap with the developing roller 42, regulates the movement of a part of the developer held on a surface of the developing roller 42, and sets a thickness of the developer held on the surface of the developing roller 42 to a predetermined thickness.

Next, the magnet 42B disposed inside the developing sleeve 42A will be described. The magnet 42B is provided with five poles of magnetic poles N1 to N3 (N poles) and S1 and S2 (S poles) along a circumferential direction of the magnet 42B. The magnetic pole N2 (pickup pole) sucks the developer transported by the supply auger 43B and attaches the developer to a surface of the developing sleeve 42A. The magnetic pole S2 (trimming pole) faces the regulating member 45, and holds the developer to be trimmed to a predetermined layer thickness set by the regulating member 45. The magnetic poles N3 and N1 serve as transport poles, and move the developer on the developing sleeve 42A to a downstream side in a rotation direction of the developing sleeve 42A.

The magnetic pole S1 faces the photoconductor drum 31, and holds the developer transported from the magnetic pole N1 by rotation of the developing sleeve 42A, A developing bias voltage is applied between the developing sleeve 42A and the photoconductor drum 31 to form an electric field, the toner in the developer moves to the photoconductor drum 31, and a carrier in the developer is held by the magnetic pole S1 to prevent attachment to the photoconductor drum 31. A pick-off pole forms a repulsive magnetic field together with the adjacent magnetic poles N2 and N3 of same polarity, and separates the developer on the developing sleeve 42A from which the toner is consumed in a development from the developing sleeve 42A.

(2.3) Configuration and Operation of Exit Path

Figure 5A:
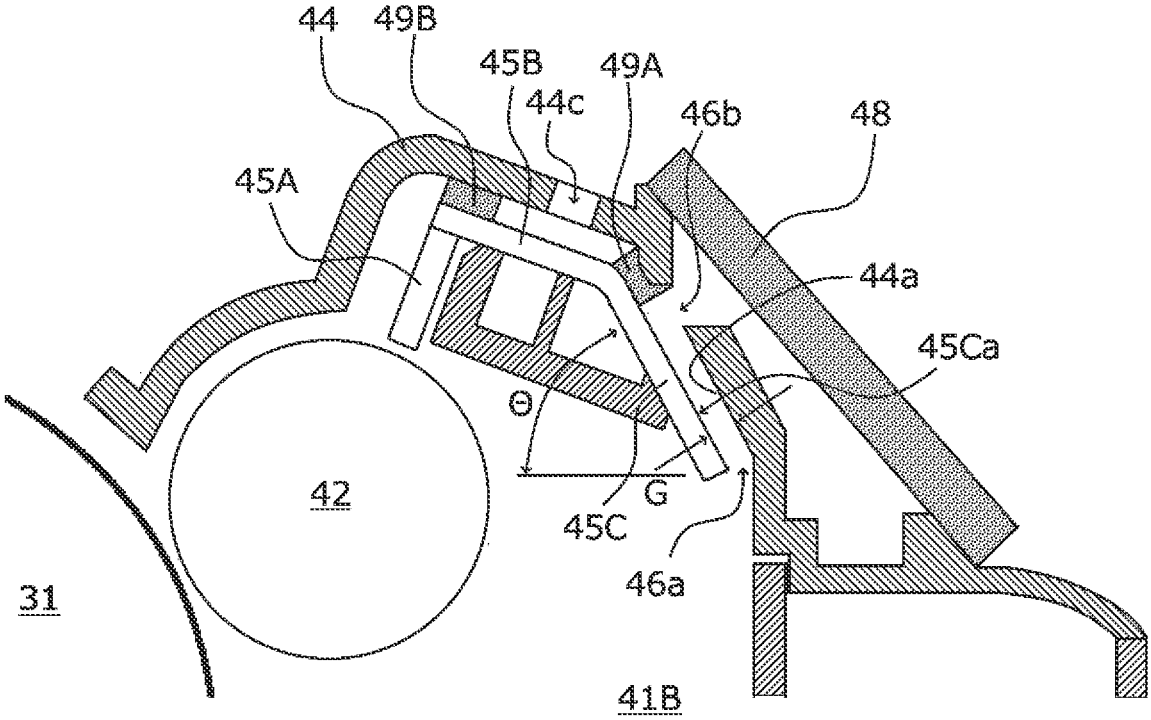
FIG. 5A is an enlarged view of portions indicated by reference sign A in FIG. 4 showing configurations of exit paths, in which reference signs related to a first exit path are indicated.
Figure 5B:
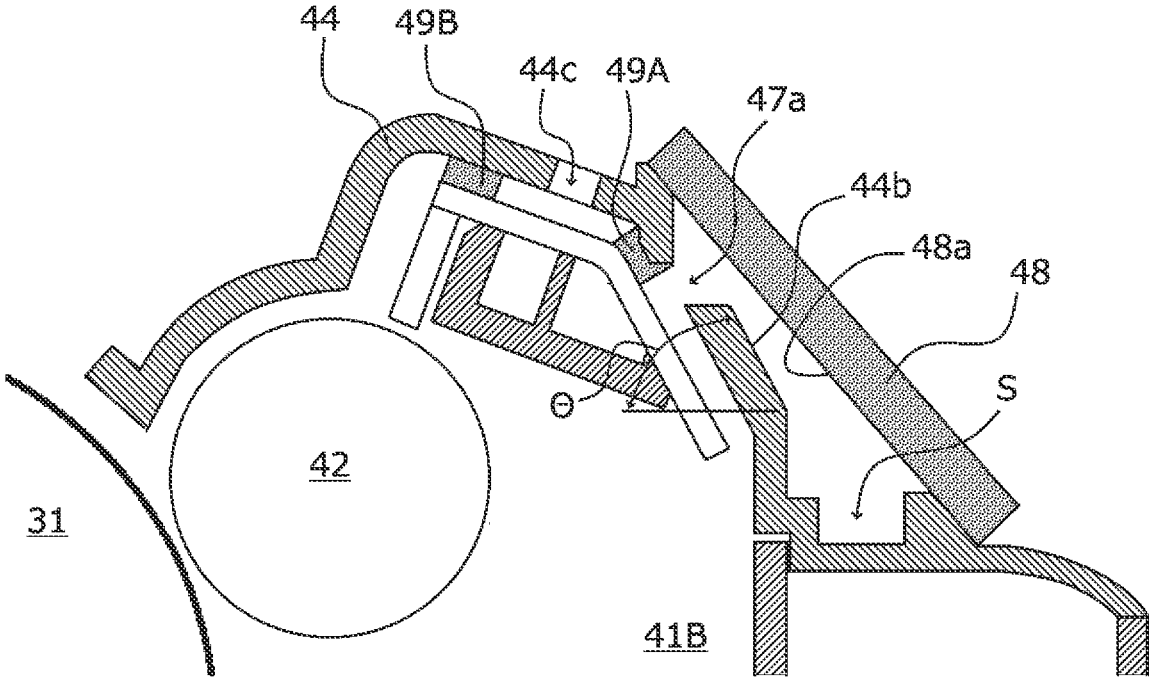
FIG. 5B is an enlarged view of portions indicated by reference sign A in FIG. 4 showing configurations of exit paths, in which reference signs related to a second exit path are indicated.
Figure 6:
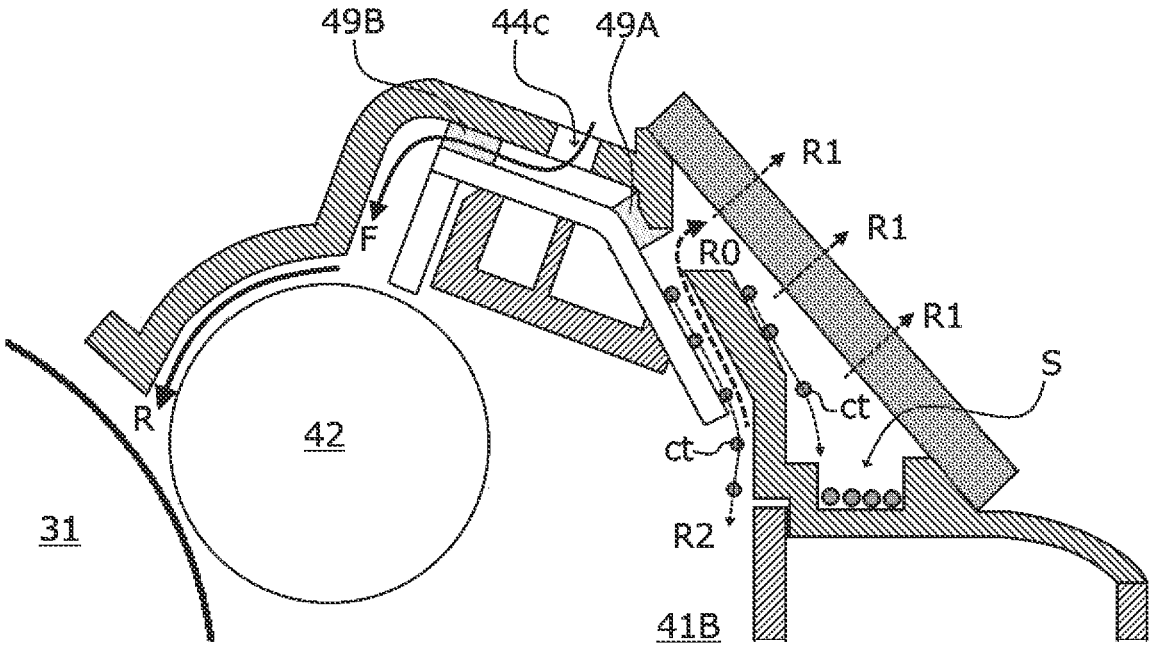
FIG. 6 is a schematic cross-sectional view schematically showing flow of air and movement of a cloud toner in the developing device.

FIGS. 5A and 5B are enlarged views of portions indicated by reference sign A in FIG. 4 showing configurations of exit paths. FIG. 6 is a schematic cross-sectional view schematically showing flow of air and movement of a cloud toner ct in the developing device 14. Reference signs related to a first exit path 46 are indicated in FIG. 5A, and reference signs related to a second exit path 47 are indicated in FIG. 5B, to show configurations of the exit paths.

In the developing device 14, an air exit path for exiting air inside the developing housing 41 to an outside of the developing housing 41 is provided in the cover member 44. A filter member 48 is provided at a portion where the exit path is connected to the outside, and collects the cloud toner ct contained in the air flowing through the exit path and exited.

In the present exemplary embodiment, the exit paths include a first exit path 46 formed to be inclined toward an inside of the developing housing 41 and configured to exit air from the inside of the developing housing 41 to the outside of the developing housing 41, and a second exit path 47 connected to the first exit path 46 and connected to the filter member 48 provided on the cover member 44 from the first exit path 46 (see FIG. 4).

A part of the regulating member 45 and an inner wall surface 44*a* of the cover member 44 are disposed to have a gap between the part of the regulating member 45 and the inner wall surface 44*a*, facing each other, the gap being the first exit path.

As shown in FIG. 5A, the regulating member 45 includes a regulator 45A that faces the developing roller 42 with a predetermined gap between the developing roller 42, an attachment 45B that intersects with the regulator 45A and extends from the regulator 45A, and a guide 45C that intersects with the attachment 45B and extends from the attachment 45B and inclines toward the inside of the developing housing 41. The first exit path 46 is a gap G between an upper surface 45Ca of the guide 45C and the inner wall surface 44*a* of the cover member 44 that closes the opening in an upper portion of the developing housing 41.

The first exit path 46 is inclined toward an inside of the developer container 41B of the developing housing 41 in which the supply auger 43B is disposed, An air inlet 46*a* of the first exit path 46 is positioned above the developer container 418. In the developing device 14, since the developer supplied from the toner cartridge T via the developer supply device 100 is transported to the developer container 41B and circulated while being stirred in the developer container 41A, the amount of the cloud toner in the developer container 41B is less than the amount of the cloud toner in the developer container 41A. Therefore, in the present exemplary embodiment, the air inlet 46*a* faces the inside of the developer container 41B, so that an amount of cloud toner ct contained in the air exited from the first exit path 46 is reduced.

The guide 45C of the first exit path 46 is inclined so as to be a downward slope at an angle Θ (shown in FIG. 5A) that exceeds an angle of repose of the toner contained in the developer. The angle of repose of the toner varies depending on a type of the developer, a usage environment such as the temperature and humidity.

Accordingly, as shown in FIG. 6, even if the cloud toner et attaches to the upper surface 45Ca of the guide 45C of the regulating member 45, the toner carried on the attached toner slides down (see an arrow R2 in FIG. 6), and accumulation of the toner on the upper surface 45Ca of the guide 45C may be prevented.

The upper surface 45Ca of the guide 45C may be subjected to a surface treatment to prevent the toner adhering to the upper surface 45Ca. Examples of the surface treatment include a flame treatment, a corona treatment, a plasma treatment, a polishing treatment, a roughening treatment, an active energy ray irradiation treatment, an ozone treatment, a surfactant treatment, and a silane coupling treatment. These treatments may be combined. In addition, a fluororesin tape or the like may be attached to the upper surface 45Ca. Accordingly, the accumulation of the toner on the upper surface 45Ca of the guide 45C is prevented.

An exit port 46*b* on a downstream side in a flow direction of the air in the first exit path 46 (see an arrow R0 in FIG. 6) is connected to the second exit path 47.

As shown in FIG. 5B, an outer surface 44*b* of the cover member 44 and an inner surface 48*a* of the filter member 48 face each other with a gap between the outer surface 44*b* and the inner surface 48*a*, the gap being the second exit path 47 inclined along the first exit path 46. That is, similarly to the first exit path 46, the outer surface 44*b* is inclined so as to be a downward slope at an angle Θ (shown in FIG. 5B) that exceeds the angle of repose of the toner contained in the developer. Accordingly, the accumulation of the toner on the outer surface 44*b* of the cover member 44 may be prevented.

In addition, the outer surface 44*b* of the cover member 44 that forms the second exit path 47 may be subjected to a surface treatment to prevent the toner adhering to the outer surface 44*b* of the cover member 44. Examples of the surface treatment include a surfactant treatment and attachment of a fluororesin tape. Accordingly, the accumulation of the toner on the upper surface 45Ca of the guide 45C is prevented.

As shown in FIG. 5B, the second exit path 47 is formed so that the gap between the outer surface 44*b* and the inner surface 48*a* is widened along a lower direction of the inclination, and a pocket space S is formed in a lower end portion of the second exit path 47. Accordingly, the cloud toner ct that slides on the outer surface 44*b* of the cover member 44 may be stored. The space S has such a size that an amount of stored toner does not become full at a replacement interval of the developing device 14.

An air inlet 47*a* of the second exit path 47 is connected to the exit port 46*b* of the first exit path 46, and an exit port 47*b* of the second exit path 47 faces the filter member 48 that is provided on the cover member 44 and prevents passage of the developer and allows passage of air. Accordingly, as shown in FIG. 6, the air inside the developing device 14 flows from the inside of the developer container 41B through the first exit path 46 toward the second exit path 47 (see the arrow R0 in FIG. 6), passes through the filter member 48, and is exited to an outside of the developing device 14 (see arrows R1 in FIG. 6).

The filter member 48 is attached directly to the upper surface 44*a* of the cover member 44 by a double-sided tape (not shown) so as to close the exit port 47*b* of the second exit path 47 in an upper portion of the cover member 44. This makes it possible to facilitate assembly while saving space in the developing device 14.

A material of the filter member 48 is not particularly limited, and a polyolefin (PE, PP, or the like), a polyamide, a polyester (PET or the like), an aromatic polyamide, or a composite material thereof may be used. As an example, by using a porous material having a collection efficiency of 25% (particle diameter of 0.3 μm to 0.5 μm) and a pressure loss of about 3 Pa at 10 cm/sec, an increase in a pressure in the developing device 14 may be prevented by passing air while preventing passage of the cloud toner ct generated in the developing housing 41.

Figure 8:
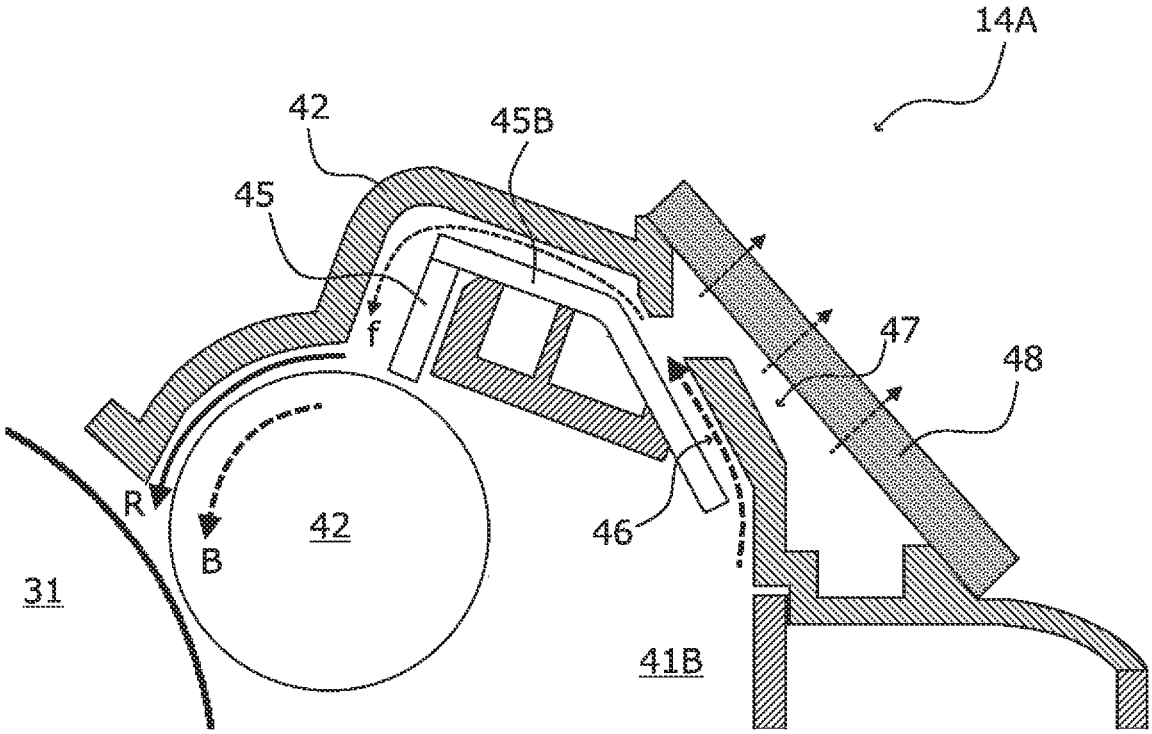
FIG. 8 is a schematic cross-sectional view schematically showing flow of air and movement of the cloud toner in a developing device of a comparative example in which the cover member is not provided with an opening for connecting to an outside.

FIG. 8 schematically shows flow of air and movement of the cloud toner ct in a developing device 14A of a comparative example in which the cover member is not, provided with an opening for connecting to the outside.

As shown in FIG. 8, in the developing device 14A, a strong rotation airflow R is generated around the developing roller 42 by rotation of the developing roller 42. Due to the rotation airflow R, a negative pressure is generated in the gap between the regulating member 45 and the cover member 44 above the developing roller 42, and there is a possibility that the air flowing through the first exit path 46 flows into the gap (see an arrow f in FIG. 8).

In the developing device 14 according to the present exemplary embodiment, as shown in FIGS. 5A and 5B, a first seal member 49A that blocks inflow of air from the first exit path 46 is disposed between the attachment 45B of the regulating member 45 and the cover member 44. An example of the first seal member 49A is a foam sponge. Accordingly, the inflow of air from the inside of the first exit path 46 is prevented.

As shown in FIGS. 5A and 5B, a second seal member 49B that blocks the flow of air associated with the rotation airflow R generated by the rotation of the developing roller 42 is disposed between the attachment 45B of the regulating member 45 and the cover member 44, and the cover member 44 is provided with an opening 44*c* connected to the outside in a region surrounded by the first seal member 49A and the second seal member 49B. Plural openings 44*c* are provided in an axial direction of the developing roller 42.

Thus, by closing the space between the attachment 45B of the regulating member 45 and the cover member 44 with the first seal member 49A and then providing the cover member 44 with the opening 44*c* connected to the outside to be open to the atmosphere, (see an arrow F in FIG. 6), the air including the cloud toner ct is prevented from being sucked and exited from the first exit path 46.

Figure 7:
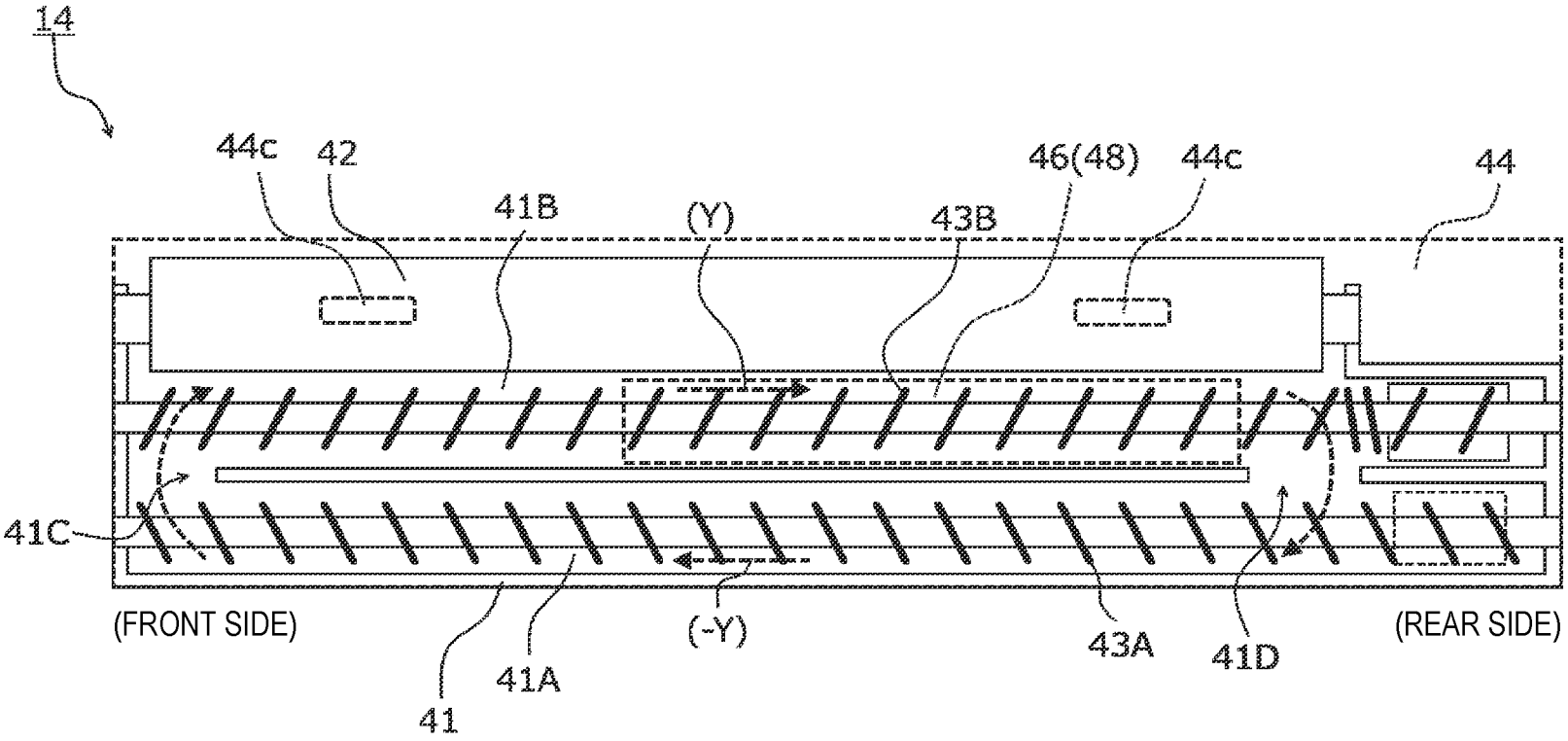
FIG. 7 is a schematic plan view schematically showing arrangement positions of the first exit path and openings in the developing device by broken lines.

FIG. 7 schematically shows arrangement positions of the first exit path 46 and the openings 44*c* in the developing device 14 by broken lines.

As shown in FIG. 7, the first exit path 46 is connected to the inside of the developer container 41B as the second circulation path through which the supply auger 43B transports the developer to the rear side (the arrow (Y) direction) while stirring the developer, and is formed on a terminal end side (rear side) in a transport direction of the developer container 41B as the second circulation path. That is, the air is exited from a region in the developing device 14 where the cloud toner ct is less generated. Accordingly, an amount of the cloud toner ct to be exited may be reduced.

As shown in FIG. 7, the openings 44*c* are provided at two locations on the front side and the rear side above the developing roller 42. Accordingly, the generation of the negative pressure due to the rotation of the developing roller 42 in the axial direction of the developing roller 42 is prevented.

In the present exemplary embodiment, a case where the regulating member 45 is disposed above the developing roller 42 is described as an example, but the regulating member 45 may be disposed below the developing roller 42. In this case, the first exit path 46 may be formed by disposing a plate member (not shown) facing an inner surface of the cover member 44 with a gap without using a part of the regulating member 45.

The foregoing description of the exemplary embodiments of the present invention has been provided for the purposes of illustration and description. It is not intended to be exhaustive or to limit the invention to the precise forms disclosed. Obviously, many, modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a housing in which a developer is contained;

a cover configured to cover an upper opening of the housing;

a developer holder that is supported by the housing and holds the developer on an outer surface and rotates;

a regulating member that faces the developer holder and configured to regulate an amount of the developer on the outer surface;

a first exit path inclined toward an inside of the housing and configured to exit air from the inside of the housing to an outside of the cover; and a second exit path that connects the first exit path and a filter provided on the cover, the filter preventing passage of the developer and allowing passage of the air, wherein the regulating member includes a regulator that faces the developer holder with a predetermined gap between the regulator and the developer holder, an attachment that intersects with the regulator and extends from the regulator, and a guide that is directly in contact with and intersects the attachment and inclines toward the inside of the housing, the first exit path is a gap between an upper surface of the guide and an inner surface of the cover facing each other, and the second exit path is a gap between an outer surface of the cover and an inner surface of the filter facing each other and inclining along the first exit path.

2. The developing device according to claim 1, wherein the developer holder rotates about an axis, and the regulator and guide extend in the direction of the axis.

3. The developing device according to claim 1, wherein the guide is inclined at an angle that exceeds an angle of repose of the toner contained in the developer.

4. An image forming apparatus comprising:

an image holder on which an electrostatic latent image is formed on a surface; and the developing device according to claim 1 that supplies a toner to the electrostatic latent image formed on the surface of the image holder to develop the electrostatic latent image.

5. The developing device according to claim 1, wherein the filter inclines so as to close the second exit path.

6. The developing device according to claim 5, wherein the filter is bonded to the cover by a double-sided tape.

7. The developing device according to claim 1, wherein the housing includes a first circulation path that transports the developer while stirring the developer, and a second circulation path that supplies the stirred developer to the developer holder while transporting the developer, and the first exit path is connected to the second circulation path.

8. The developing device according to claim 7, wherein the first exit path is formed on a terminal end side in a transport direction of the second circulation path.

9. The developing device according to claim 1, wherein the second exit path is inclining in the same direction as the first exit path.

10. The developing device according to claim 9, wherein the second exit path inclines at the angle that exceeds the angle of repose of the toner contained in the developer.

11. The developing device according to claim 9, wherein the second exit path is formed so that the gap between the outer surface of the cover and the inner surface of the filter is widened along a lower direction of an inclination.

12. The developing device according to claim 9, wherein the outer surface of the cover is subjected to a surface treatment for preventing the toner adhering to the outer surface of the cover.

13. The developing device according to claim 1, wherein the first exit path is inclined at an angle that exceeds an angle of repose of the toner contained in the developer.

14. The developing device according to claim 13, wherein the upper surface of the guide is subjected to a surface treatment for preventing the toner adhering to the upper surface of the guide.

15. The developing device according to claim 14, wherein the second exit path is inclining in the same direction as the first exit path.

16. The developing device according to claim 13, wherein the second exit path is inclining in the same direction as the first exit path.

17. The developing device according to claim 16, wherein the second exit path inclines at the angle that exceeds the angle of repose of the toner contained in the developer.

18. A developing device comprising:

a housing in which a developer is contained;

a cover configured to cover an upper opening of the housing;

a developer holder that is supported by the housing and holds the developer on an outer surface and rotates;

a regulating member that faces the developer holder and configured to regulate an amount of the developer on the outer surface;

a first exit path inclined toward an inside of the housing and configured to exit air from the inside of the housing to an outside of the cover; and a second exit path that connects the first exit path and a filter provided on the cover, the filter preventing passage of the developer and allowing passage of the air, wherein the regulating member includes a regulator that faces the developer holder with a predetermined gap between the regulator and the developer holder, an attachment that intersects with the regulator and extends from the regulator, and a guide that intersects with the attachment and inclines toward the inside of the housing, and the first exit path is a gap between an upper surface of the guide and an inner surface of the cover member facing each other, wherein a first seal that blocks inflow of air from the first exit path is disposed between the attachment of the regulating member and the cover.

19. The developing device according to claim 18, wherein a second seal that blocks a flow of air generated by rotation of the developer holder is disposed between the attachment of the regulating member and the cover, and the cover is provided with an opening connected to an outside in a region surrounded by the first seal and the second seal.

* * * * *